US005795272A

United States Patent [19]

Brenke

[11] Patent Number: 5,795,272

[45] Date of Patent: Aug. 18, 1998

[54] TRAINING APPARATUS

[75] Inventor: Horst Brenke, Kreischa, Germany

[73] Assignee: Rudolf Presl, Kreischa, Germany

[21] Appl. No.: 632,431

[22] PCT Filed: Oct. 28, 1994

[86] PCT No.: PCT/EP94/03549

§ 371 Date: Jul. 3, 1996

§ 102(e) Date: Jul. 3, 1996

[87] PCT Pub. No.: WO95/12435

PCT Pub. Date: May 11, 1995

[30] Foreign Application Priority Data

Nov. 4, 1993 [DE] Germany ..... 93 16 910 U

[51] Int. Cl.[6] ..... A63B 21/06

[52] U.S. Cl. ..... 482/103; 482/99; 482/142

[58] Field of Search ..... 482/72, 99, 102, 482/103, 133, 138

[56] References Cited

U.S. PATENT DOCUMENTS 4,634,118 1/1987 Jensen ..... 482/133 X
4,907,798 3/1990 Burchatz ..... 482/99

FOREIGN PATENT DOCUMENTS 3500434 7/1986 Germany ..... 482/102

*Primary Examiner*—Richard J. Apley
*Assistant Examiner*—John Mulcahy
*Attorney, Agent, or Firm*—McAndrews, Held & Malloy, Ltd.

[57] ABSTRACT

A training device for strengthening the back muscles provides a stepped berth for the trainee. Cables are coupled to weights and guided by first diverting rollers which are horizontally adjustable beneath the berth and second diverting rollers at the head end of the berth. Handles are provided at the free end of the cables. The trainee may pull the cables either from the first diverting rollers or from the second diverting rollers at increased tension.

4 Claims, 2 Drawing Sheets

TRAINING APPARATUS

FIELD OF THE INVENTION

The present invention concerns a training device, especially for strengthening the muscles of the back, with a stepboard-like reclining and sitting device and a weight-guiding tension device.

DESCRIPTION OF THE PRIOR ART

Stepboards for strength training are familiar. As compared to the previously used horizontal layout boards, which resulted in great hyperlordosis when training with heavy loads or high numbers of repetitions in the power endurance range, this can be avoided with the use of stepboards. Studies have shown that the stepboard is well suited as a training device to strengthen the muscles of the arm and shoulder region while mostly avoiding strain on the spinal cord. At the same time, in addition to the dynamic loading of the upper limbs, a strong isometric tensioning of the back musculature can also be demonstrated. Consequently, the back musculature can be exercised on the familiar stepboards while largely sparing the lumbar and thoracic spinal column.

Weight-guiding tension devices are known and are used for all types of strength training. However, a disadvantage with the state of the art is that the stepboard-like reclining and sitting device and the weight-guiding tension device are each known only as individual devices. But in medical training therapy it is often necessary to combine the actions and benefits of different training devices for optimal treatment. According to the state of the art, this is only possible by placing the training devices next to each other. Because of their weight, especially that of the weight-guiding tension device, this involves a large expenditure of time and effort.

SUMMARY OF THE INVENTION

The purpose of the invention is to provide a training device, especially one for strengthening the back musculature, which has the most compact possible structure and can be operated without additional expenditure of effort.

The features of the main claim serve to accomplish this purpose.

Advantageous embodiments are described in the subsidiary claims.

The training device according to the invention, thanks to the combination of a reclining and sitting device and a pulling device to form a unified device, ensures that continual transporting of the reclining and sitting device up to the pulling device and back need not be done. Advantageously, the reclining and sitting device and the pulling device are arranged in a support frame, so that the training device has a compact structure on the whole.

In an advantageous embodiment of the invention, the reclining and sitting device is angled at the end away from the pulling device and its height can be adjusted. This ensures that the reclining and sitting device can be adapted in optimal manner to the body structure of the particular user.

In another advantageous embodiment, first diverting rollers are arranged in guided and adjustable manner on the support frame of the invented training device, underneath the reclining and sitting device. This ensures a variable guidance of a tension cable in the diverting rollers, so that the most diverse tensile stresses can be adjusted.

BRIEF DESCRIPTION OF THE DRAWINGS

A preferred embodiment of the invented training device shall be explained more closely hereafter by means of the enclosed drawings, as an example.

These show.

DESCRIPTION OF THE PREFERRED EMBODIMENTS

Figure 1:
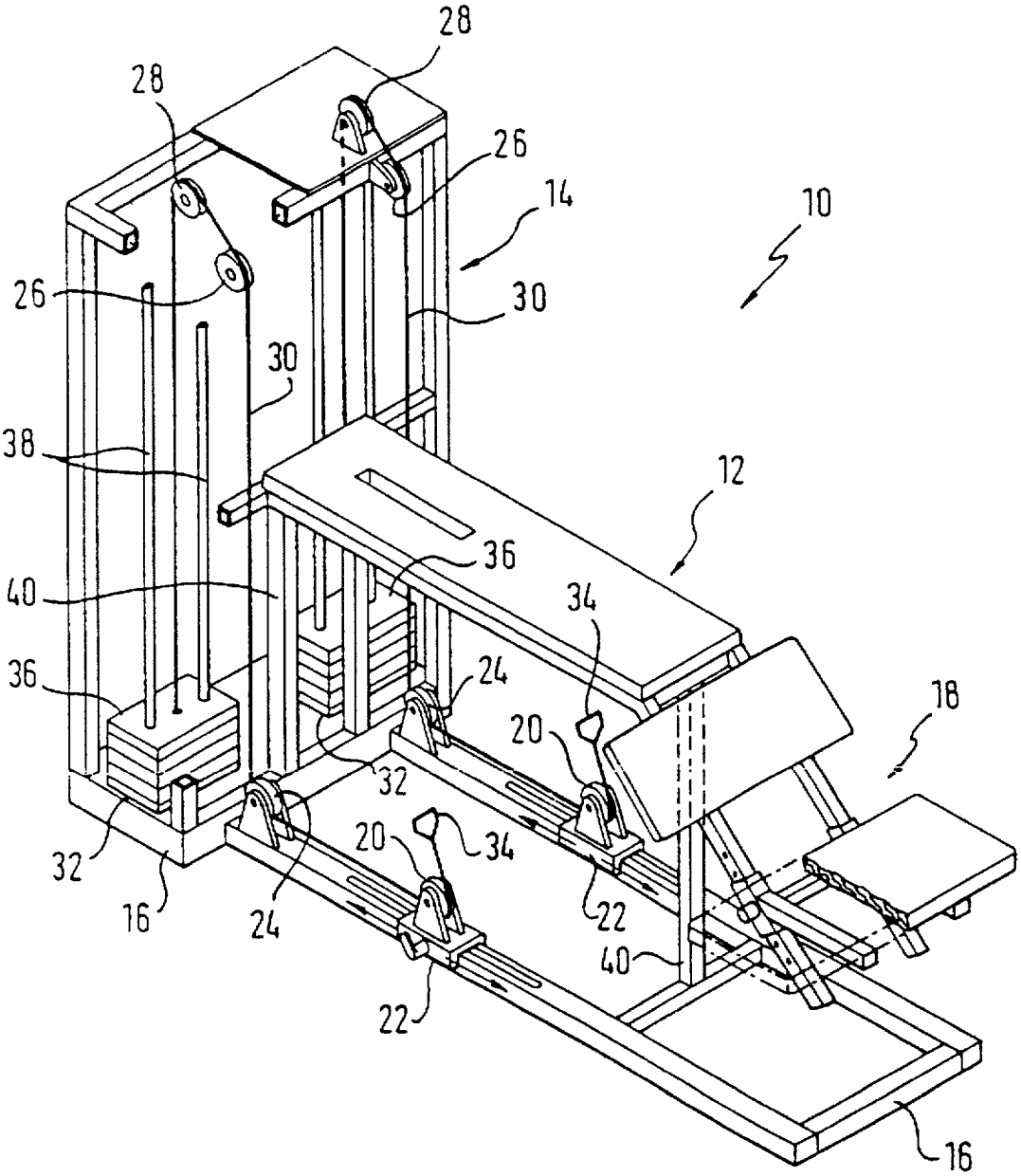
FIG. 1: a schematic, partially cut perspective view of the invented training device

A training device shown in FIG. 1 in a schematic perspective view, especially one for strengthening the back muscles 10, comprises a reclining and sitting device 12 and a pulling device 14, the reclining and sitting device 12 and the pulling device 14 being arranged in a support frame 16. The reclining and sitting device 12 is fashioned like a stepboard, being angled at the end 18 away from the pulling device 14 and adjustable in height. The reclining and supporting device 12 is firmly joined to the support frame 16 by means of prop connections 40. The support frame 16 has several diverting rollers 20, 24, 26, 28 to guide a tension cable 30. At one end of the tension cable 30 is secured a weight holder 32, the opposite end of the tension cable 30 is fashioned as hand loops 34. The weight holder 32 serves to hold weights 36, having one or more openings, which serve to guide the weights on guide rods 38.

The first diverting rollers 20 are arranged adjustably on the support frame 16 underneath the reclining and sitting device and are guided by means of a carriage 22 on the support frame 16. The carriage 22 can be immobilized.

Figure 2:
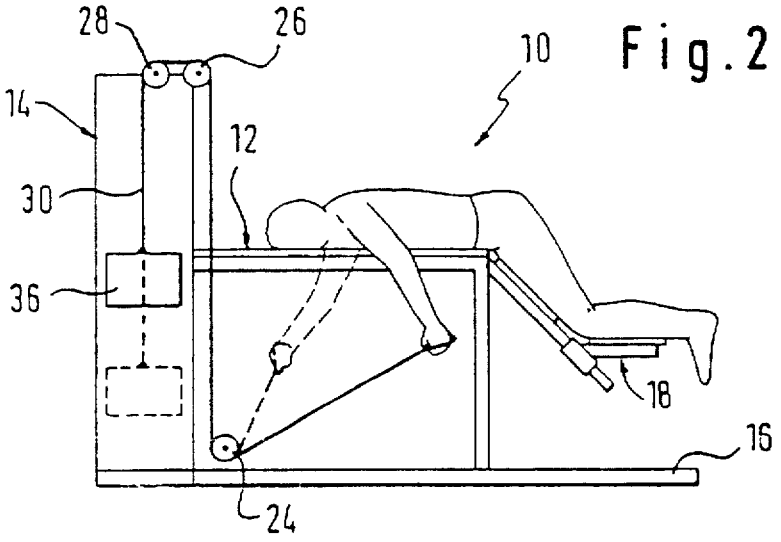
FIGS. 2–4: a schematic representation of the possible applications of the invented training device.
Figure 3:
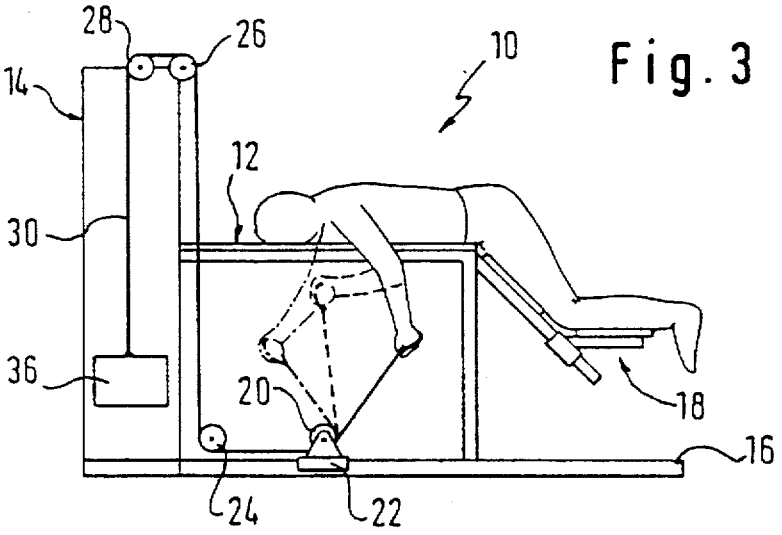
Figure 4:
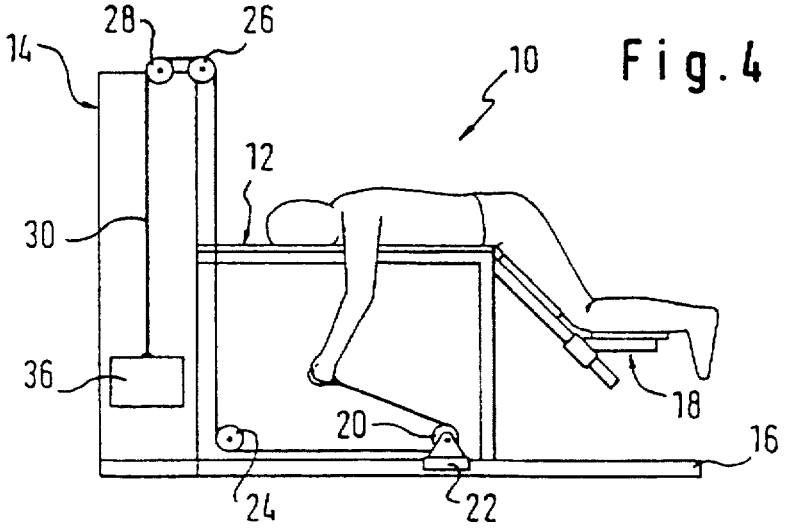

FIGS. 2–4 show schematically the various possible applications of the invented training device 10. FIG. 2 shows a guiding of the tension cable 30 across the diverting rollers 28, 26 and 24, having no need for the diverting roller 20. By guiding the tension cable 30 through only three diverting rollers 24, 26, 28, the tensile loading from the weights 36 is increased. FIGS. 3 and 4 show, on the contrary, a guiding of the tension cable 30 across four diverting rollers 20, 24, 26, 28. It will be recognized that different stress patterns are created by the possibility of shifting the roller 20 by means of the carriage 22 on the support frame 16. This ensures that the invented training device 10 can be used for various exercise alternatives, which can be adapted to different exertion requirements.

I claim:

1. A training device for use by a trainee, comprising:

a) a berth (12), having three segments essentially forming a step, namely, a first one to hold the upper body, at a head end of the berth, a second one to hold the upper legs of a foot end of the berth, and a third one to hold the lower legs, b) a weight-guiding pulling device (14) having a first and a second tension cable (30), c) the berth (12) and the pulling device (14) being combined in a common support frame (16) to form a unified device, d) the distance between the first and the third segments of the step being adapted for adjustment to the particular size of a trainee's body, e) two first diverting rollers (20), to guide the first and the second tension cables (30), respectively, the first diverting rollers being arranged horizontally adjustably underneath the berth (12) on the support frame (16) so that a trainee lying with his stomach on the berth (12) with his knees bent and his arms hanging down can grasp a free end of a tension cable in each hand and perform various pulling exercise alternatives according to the horizontal position of the first diverting rollers (20), and f) two second diverting rollers (24), to guide the first and second tension cables (30), respectively, the second diverting rollers being arranged at the head end of the berth approximately level with the first diverting rollers to guide the cable to the first diverting rollers, the cable being removable from the first diverting rollers whereby the cable may be alternatively pulled from the second diverting rollers.

2. A training device according to claim 1 wherein the berth (12) is adjustable in height at an end (18) away from the pulling device (14).

3. A training device according to claim 1 further comprising two, third, and fourth diverting rollers (26, 28) for guiding the first and second tension cables (30), said first and second tension cables having at one end a weight holder (32), and at the free end a hand loop (34).

4. A training device according to claim 1 wherein the first diverting rollers (20) are each adjustably guided by means of a carriage (22) to a plurality of positions on the support frame (16), the carriage being adapted to be locked in position.

* * * * *